US006827215B1

(12) United States Patent
Lane

(10) Patent No.: US 6,827,215 B1
(45) Date of Patent: Dec. 7, 2004

(54) CONTAINER SYSTEM ADAPTED TO BE ACCESSED BY A USER RIDING A HORSE

(76) Inventor: Barry L. Lane, 461 Colvin Dr., Locust Grove, GA (US) 30248

( * ) Notice: Subject to any disclaimer, the term of this patent is extended or adjusted under 35 U.S.C. 154(b) by 291 days.

(21) Appl. No.: 10/099,437

(22) Filed: Mar. 15, 2002

(51) Int. Cl.[7] ..... B65D 85/00; B65D 85/20; B65D 85/30; B68B 11/26

(52) U.S. Cl. ..... 206/525; 206/579; 206/315.1; 206/349; 231/2.1; 220/475

(58) Field of Search ..... 206/525, 579, 206/315.1, 372, 373, 349, 790; 231/2.1; 54/71, 84; 119/712; 248/311.2, 318, 146; 220/475

(56) References Cited

U.S. PATENT DOCUMENTS

| | | | | |
|---|---|---|---|---|
| 3,301,619 A | | 1/1967 | Mead | 312/200 |
| 3,362,382 A | | 1/1968 | Frasier | 119/58 |
| 3,780,971 A | | 12/1973 | De Filipps | |
| 3,847,286 A | | 11/1974 | Garrett | |
| 4,432,459 A | * | 2/1984 | Coldren | 206/557 |
| 4,750,670 A | * | 6/1988 | Gabe | 231/2.1 |
| 4,768,651 A | * | 9/1988 | Lanius | 206/373 |
| 4,953,765 A | | 9/1990 | Little et al. | |
| 5,188,060 A | | 2/1993 | Johnson | |
| 5,547,080 A | | 8/1996 | Klimas | |
| 5,615,783 A | | 4/1997 | Warnken | |
| 5,664,367 A | * | 9/1997 | Huang | 248/311.2 |
| 5,899,420 A | * | 5/1999 | Gerardi | 248/146 |
| 5,909,717 A | | 6/1999 | Randall | |
| 5,924,615 A | | 7/1999 | McGarrah | |

* cited by examiner

*Primary Examiner*—Mickey Yu
*Assistant Examiner*—J. Gregory Pickett
(74) *Attorney, Agent, or Firm*—Holland & Knight LLP

(57) ABSTRACT

Disclosed is a container system that is adapted to be accessed by horse mounted users. The container system finds particular application in storing equestrian implements, such as riding crops. The container is mounted at an elevated height upon a fence and additionally includes rounded forward faces. Thus, the container is easy to access by riders and presents less of a danger to the horse and its rider. Furthermore, the container is advantageously formed from a weather resistant plastic material.

6 Claims, 5 Drawing Sheets

CONTAINER SYSTEM ADAPTED TO BE ACCESSED BY A USER RIDING A HORSE

BACKGROUND OF THE INVENTION

1. Field of the Invention

This invention relates to container system. More particularly, the present invention relates to a container system that is adapted to be accessed by a user mounted upon a horse.

2. Description of the Background Art

Horse back riding is a popular past time. Yet, horse back riding is an equipment intensive activity. Saddles, bits, bridles, halters and harnesses are all employed in equestrian activities. Thus, there is a continuing need for storage systems for such equipment. Ideally, storage systems will keep equestrian equipment shielded from the weather, and at the same time, provide convenient access to horseback riders.

In terms of storage, the riding crop is one piece of equipment that is often overlooked. That is, most horse farms do not have a designated area for hanging or storing riding crops. The lack of designated space also means that crops are frequently left unstored. As a consequence, riding crops are often stored with various other equipment, both equestrian and non-equestrian alike. When riding crops are left out in the open, they often get exposed to the elements, such as excessive heat, rain or cold. Invariably, these elements damage the riding crop and otherwise lead to premature wearing and fraying. This is highly undesirable, insomuch as most crops are made from expensive material, and/or require hand crafting techniques.

Additionally, riding crops, as with most other equestrian equipment are never stored in a manner that allows access by users on horseback. That is, storage is done within containers that are low to the ground or within enclosed areas. This permits access by individuals on foot, but limits access by individuals on horseback. Thus, users on horseback who need to access essential equipment must de-mount the horse, access the equipment, and then again mount the horse. This process is further complicated if the crop is stored in an area not accessible by horseback, thereby requiring the user to secure the horse before proceeding towards the storage area. In light of the forgoing, there exits a need for improved storage facilities for all manner of equestrian equipment, which enables the secure storage of equipment in a area accessible by a rider on horseback.

The background art contains numerous examples of equestrian related storage systems. For instance, U.S. Pat. No. 5,615,783 to Warnken discloses a portable folding saddle rack. The rack includes hanger elements that are engageable with various available structures, such as a fence rail. The rack includes one or more hooks depending from a top member that provide hanger elements for receiving associated equestrian accouterments. The device further includes two saddle support arms.

Likewise, U.S. Pat. No. 3,780,971 to De Filipps discloses a collapsible saddle rack. The rack includes a hook member for attaching the rack to a fence board, stall door or the like. The saddle support member is secured to the hook. As such, a saddle may be secured adjacent a fence or stall door.

Finally, U.S. Pat. No. 4,953,765 to Little discloses a horse grooming organizer. The organizer includes a rectangular panel member having detachably secured thereto a series of storage members, such as pockets or the like. The panel is adapted to be secured to a vertical surface such as a wall or gate. The organizer is ideally located in the vicinity of a area when a horse is to be cared for or groomed.

Although each of the above referenced inventions achieves its individual objective, none of the invention disclose a storage system specifically for use in retaining riding crops or similar equestrian implements. Moreover, none of the above referenced inventions discloses a storage system that facilitates access by a user on horseback.

SUMMARY OF THE INVENTION

It is therefore one of the objectives of this invention to improve the manner in which equestrian equipment is stored. It is also an object of this invention to create a storage system specifically adapted to secure riding crops or similar equestrian implements.

It is also an object of this invention to provide a storage system which is accessible by a user on horseback.

Still another object of this invention is to keep stored equestrian equipment free from the adverse effects of weather.

Yet another object of this invention is to provide a storage system that can conveniently be stored upon a fence.

Still yet another object of this invention is to provide a storage system with rounded surfaces to limit injuries to riders and horses.

These and other objectives are accomplished by providing a container system adapted for use by users on horseback. The system includes a fence terminating at an upper edge, wherein the fence preferably has a height of between 36 and 60 inches and functions to limit the movement of horses or other livestock. Alternatively, the system could employ a fence post, solid wall or indoor ring wall. The system also includes a weather resistant plastic container. The container comprises interconnected upper and lower halves. Each half includes rounded forward and rearward surfaces interconnected by a substantially straight intermediate surface. Each half has a length of approximately 50 inches and a depth of approximately 4½ inches. A plurality of mounting apertures are formed through the rearward surface of the lower half and a plurality of mounting screws are positioned through the mounting apertures and are secured within the fence adjacent the upper edge. A plurality of drainage apertures are formed with the lower half of the container. Additionally, a plurality of hinges serve to pivotally interconnect the rearward surfaces of the upper and lower halves. A male latch component is formed upon the forward surface of the lower half, with a female latch component formed upon the forward surface of the upper half. Alternatively, a knob can be positioned upon the upper portion. Finally, the system could contain riding crops, with the preferred length of the crops being between 38 and 48 inches. The riding crop is positioned within the container, with the height of the container upon the fence permitting riders on horseback to easily access the riding crop without dismounting the horse.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in theart that the conception and the specific embodiment disclosed may be readily utilized as a basis for modifying or designing other structures for carrying outthe same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
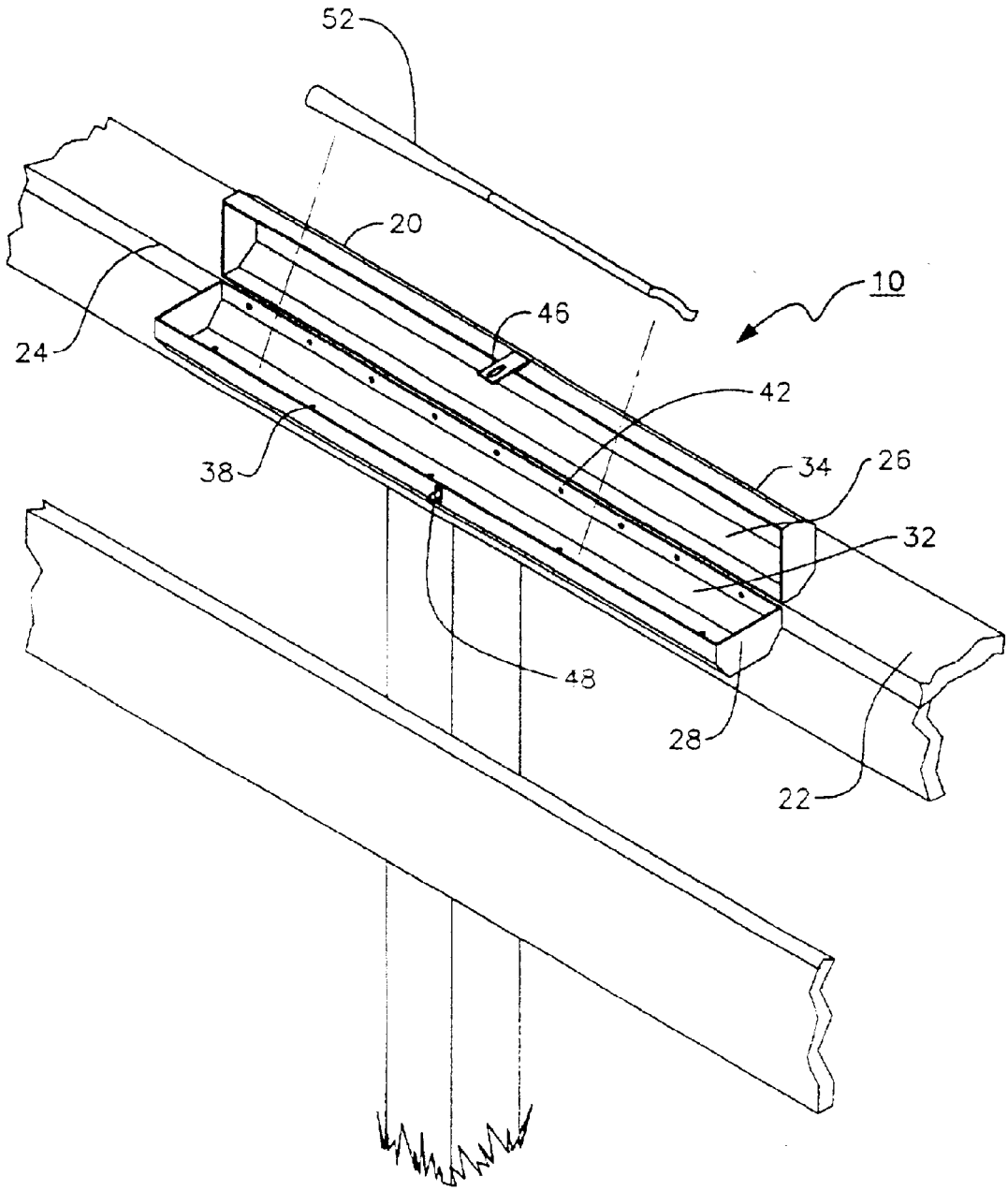
FIG. 1 is a perspective view of the container system of the present invention.

The present invention relates to a container system that is adapted to be accessed by a user on horseback. The container system finds particular application in storing equestrian implements, such as riding crops. The container is preferably mounted at an elevated height, such as upon a fence. Additionally, the container includes rounded forward faces. Thus, the container is easy to access by horseback riders and is less likely to injure a rider or horse. The various features of the present invention, and the manner in which they interrelate, are described in greater detail hereinafter.

The container 20 of the present invention finds particular application upon a fence 22. More specifically, the container 20 is secured adjacent the upper edge 24 of a conventional fence 22, such as the types of fences employed in containing horses or other livestock. These fences are typically split rail fences formed from plywood and have a height of between 36 and 60 inches. However, the system 10 can also be utilized on fence posts, solid walls, indoor riding rings, and panel or chain link fences. Further still, the present invention can be used upon a solitary post or other elevated mounting arrangement, and is not necessarily limited to use upon a fence. The essential requirement is a mounting arrangement that places the container of the present invention at a elevated height.

Ideally, once secured, the container 20 is positioned at a height of between 36 to 60 inches. The mounting height, of course, is dependent upon the height of the fence or other object upon which the container is secured. This height range permits a user to gain access to the contents of the container 20 while mounted upon a horse. The height range provided is sufficient to accommodate riders of various sizes, riding upon a range of horse breeds and heights. The details of the container 20, and its interconnection with the fence 22, are described hereinafter.

Figure 2:
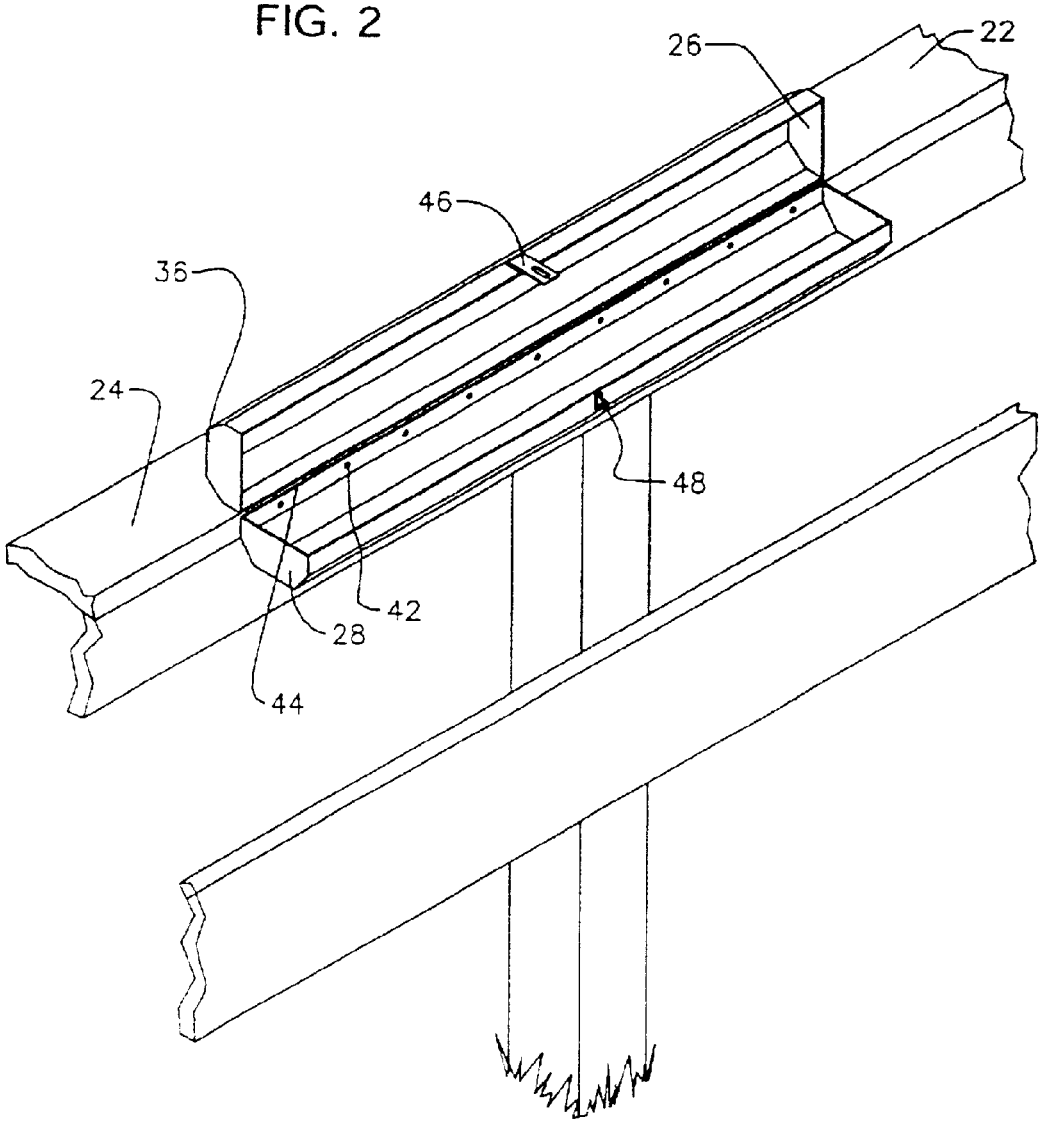
FIG. 2 is a perspective view of the container system of the present invention.
Figure 4:
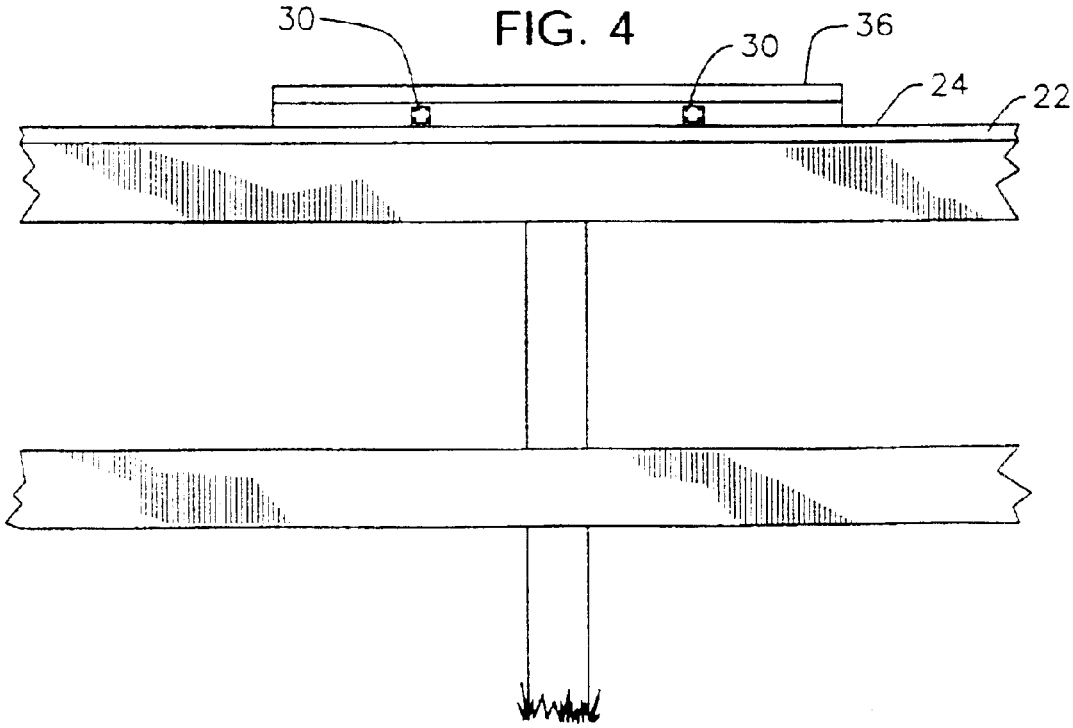
FIG. 4 is a rear elevational view of the container system of the present invention.

With reference to FIGS. 1 and 2, the container 20 of the present invention will be described. The container 20 consists upper and lower halves (26 and 28), which are hingedly interconnected to one another. More specifically, two hinges 30 (note FIG. 4) are secured to the rearward surfaces 32 of the two halves (26 and 28) and serve to pivotally interconnect the upper lid portion 26 to the lower compartment portion 28. In the preferred embodiment the hinges 30 are door type hinges and are coupled to the rear surfaces 32 of the upper and lower container halves (26 and 28) by way of screws. Yet, other hinge types and other securing means are within the scope of the present invention.

Figure 2A:
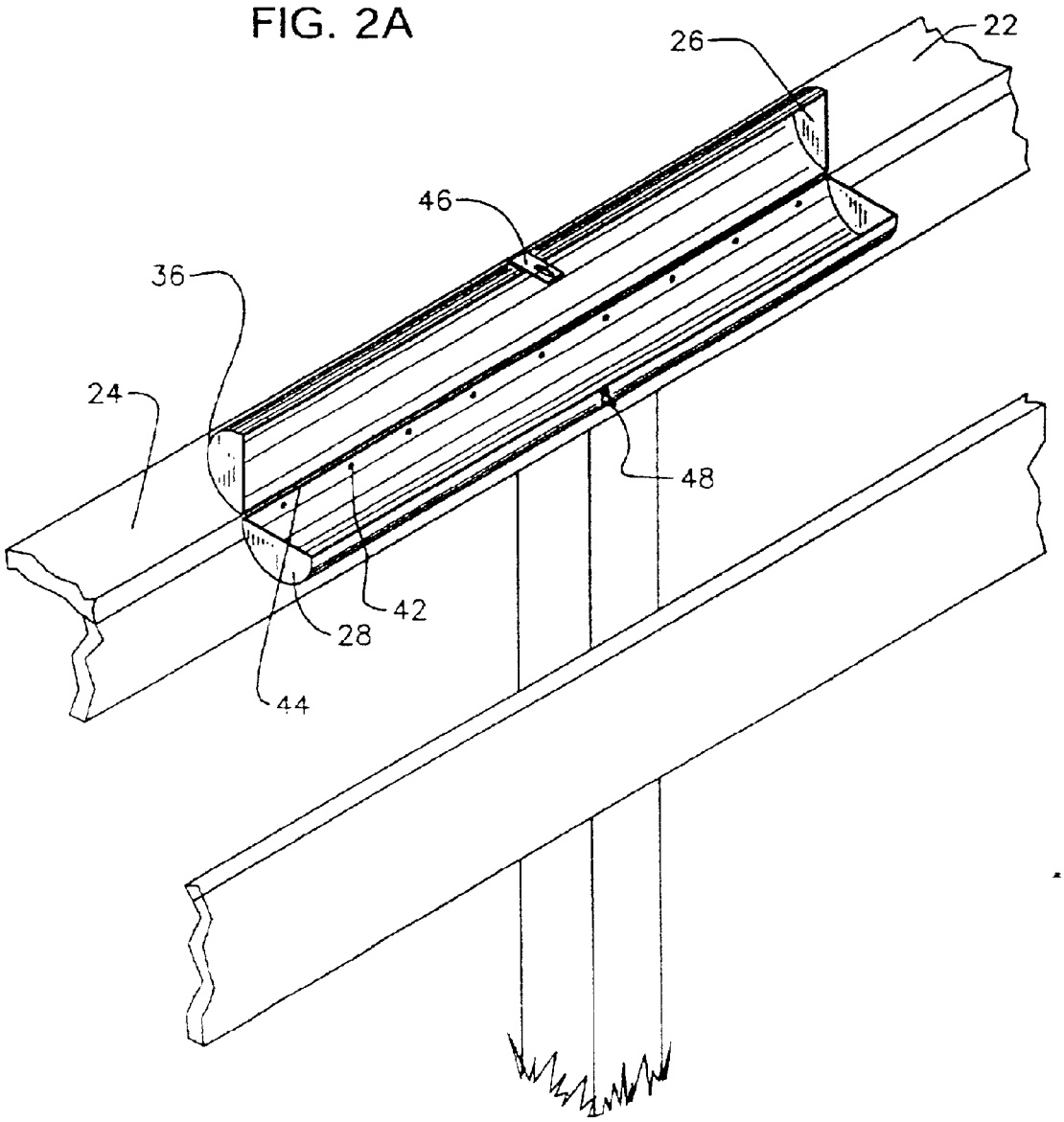
FIG. 2*a* is a perspective view of a round embodiment of the container of the present invention.
Figure 3:
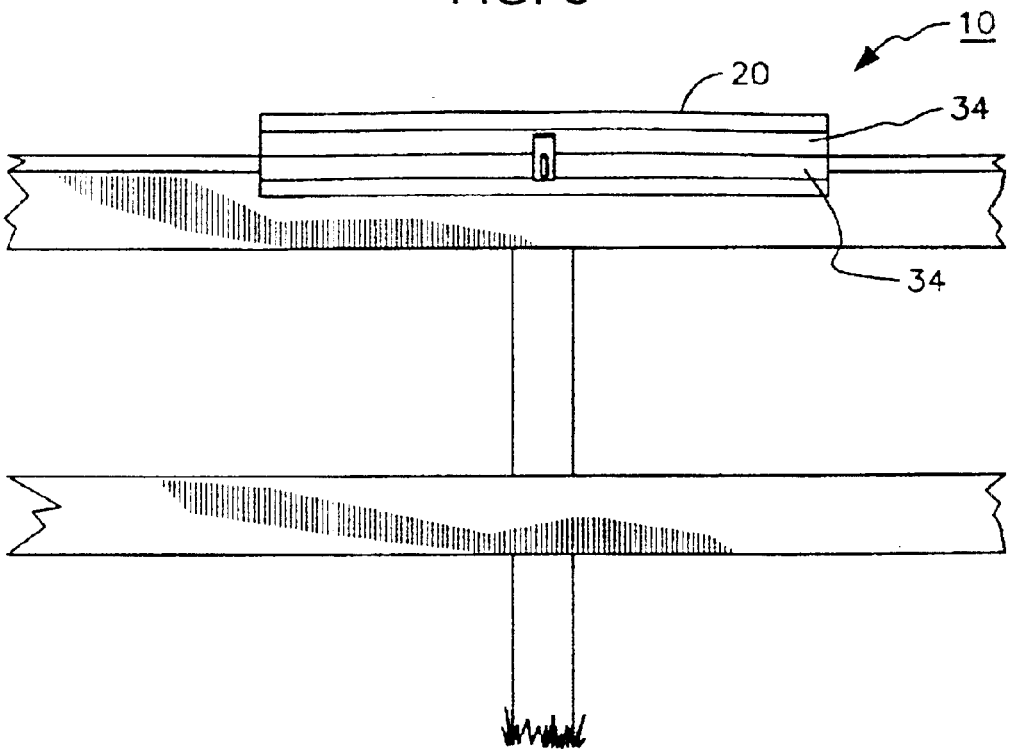
FIG. 3 is a front elevational view of the container system of the present invention.

Both the upper and lower halves 28, 26 have a similar geometry. That is, each half includes rounded forward and rearward surfaces 34 interconnected by a substantially straight intermediate surface 36. These intermediate surfaces constitute the uppermost surface of the upper half 26, and the lowermost surface of the lower half 28. Both of these surfaces are planer. The two halves 28, 26 can also be formed from a rounded shape as illustrated in FIG. 2*a*.

In the preferred embodiment, both the halves 28, 26 are formed from a hardened plastic or rubber material. These materials are preferred in that they are weather resistant and do not rust or tarnish. Additional weather resistance is created via drainage apertures. Additionally, an elastomeric seal can be included about the periphery of the upper and lower halves, 26 and 28. Such a seal would prevent moisture from seeping into the container when sealed. Specifically, a plurality of drainage apertures 38 are formed within the lowermost surface of the lower half 28 of the container 20. Thus, in the event the container 20 is left open during inclement weather, proper drainage is achieved. In the preferred embodiment, each half (26 and 28) has an elongated length of approximately 50 inches and a depth of between 4½–5 inches. This size is preferred in that it allows the container to house most equestrian implements. However, as is discussed hereinafter in conjunction with FIGS. 5 and 6, other container geometries and sizes are within the scope of the present invention.

With reference to FIGS. 1 and 2, it can be seen that the container 20 of the present invention is mounted to the fence 22 by way of a plurality of mounting apertures 42 and mounting screws 44. These mounting apertures 42 are formed through the rearward surface 32 of the lower half 28 of the container 20. The mounting screws 44 are positioned through the mounting apertures 42 and are secured within the fence 22 adjacent the upper edge 24. Preferably, a sufficient number of screws are employed to securely position the container. As discussed more fully hereinafter in conjunction with FIGS. 5 and 6, other mounting arrangements are within the scope of the present invention. These alternative arrangements can be employed in conjunction with fences that do not lend themselves to the use of mounting screws.

With the continuing references to FIGS. 1 and 2, the container 20 of the present invention also includes a latch. Specifically, a female latch component 46 is pivotally secured upon the forward surface of the upper half 26, and a corresponding a male latch component 48 is formed upon the forward surface of the lower half 28. These two latch components (46 and 48) are adapted to engage one another when the upper lid portion 26 is brought down onto the lower compartment portion 28. The latch prevents the unintended opening of the container 20 and can also be employed to lock the container with a convention key lock or combination lock. Alternatively, a knob can be positioned upon the upper component.

FIG. 1 illustrates an equestrian implement stored within the container of the present invention. The specific implement depicted is a riding crop 52. Riding crops typically have an overlength of between 38 and 48 inches. Thus, the 50 inch length of the container permits a wide range of riding crops to be easily stored. Of course, the container system 10 of the present invention can also be used to store tools or other implements with a size that is accommodated half of the container.

Figure 5:
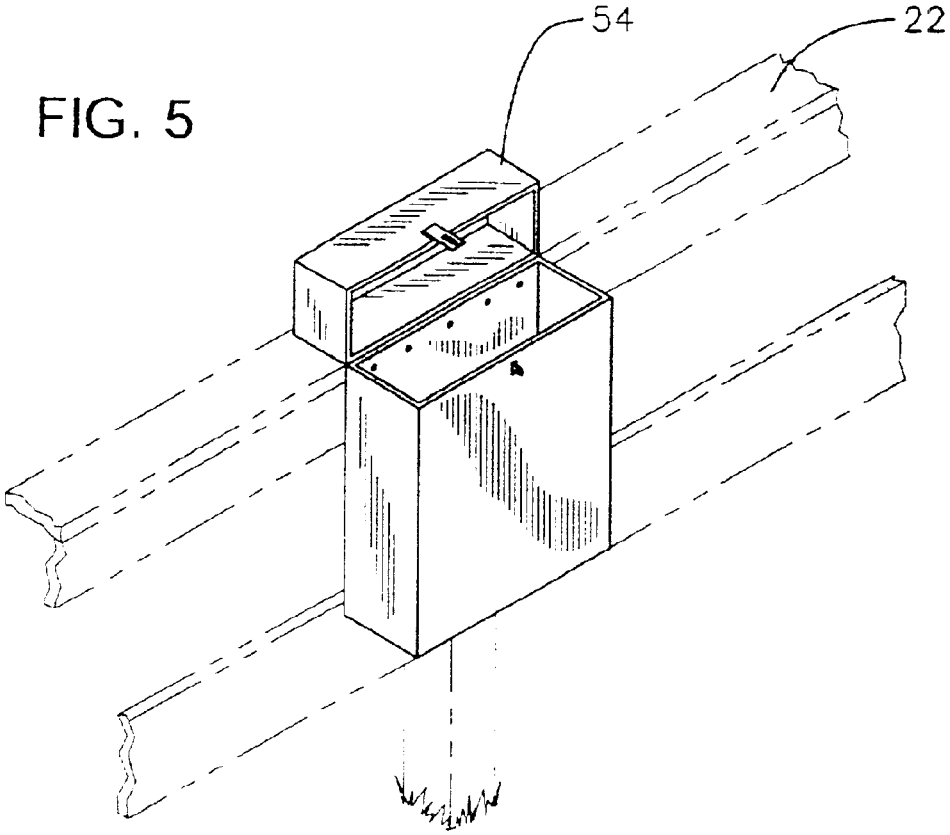
FIG. 5 is a perspective view of an alternative container system.
Figure 6:
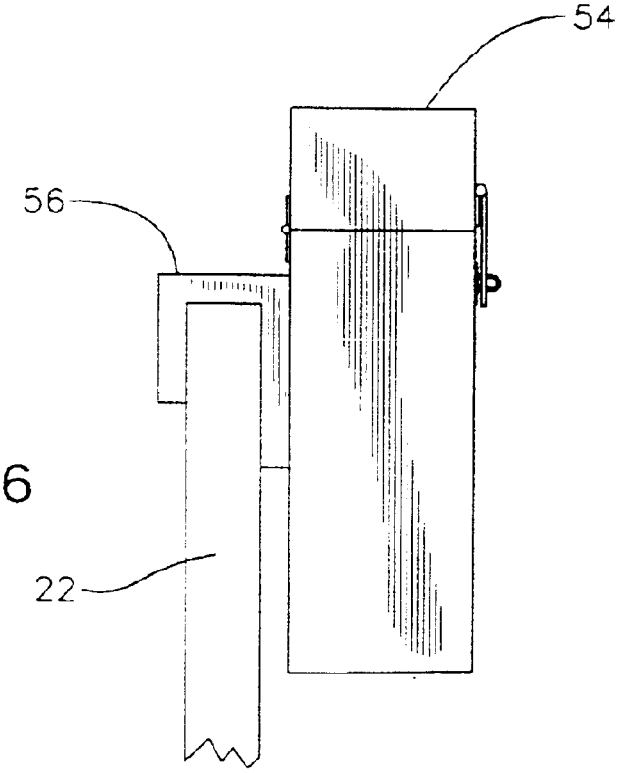
FIG. 6. is a side elevational view of an alternative container system.

FIGS. 5-6 illustrates an alternative embodiment of the container system of the present invention. This alternative embodiment is also fence mounted at a height of between 26 and 60 inches. However, the alternative container arrangement 54 is rectangular and includes a deeper lower container compartment. As such, this embodiment can be employed in storing a wider range of tools. As illustrated, in one embodiment, the rectangular container 54 is secured to the fence 22 by way of a series of screws which are secured through mounting apertures in the rearward surface of the container. This mounting arrangement is identical to the mounting arrangement described in conjunction with the primary embodiment.

FIG. 6 illustrates an alternative mounting arrangement. More specifically, FIG. 6 illustrates the container 54 secured by way of a U-shaped bracket 56. That is, mounting screws are utilized to secure a U-shaped bracket 56 to a rear surface of the container 54. This bracket 56 can then be positioned over the top of a fence 22. Depending upon the length of the container one or more U-shaped brackets 56 can be employed. The U-shaped bracket 56 is preferably employed upon fences with narrower upper potions. Normally, the upper extent of the fence must be narrow enough to fit within the U-shaped opening of bracket 56. The bracket 56 mounting arrangement has an advantage in that the attachment to the fence is not permanent. As such that container can be easily moved and transported to other locations. Furthermore, although the bracket 56 is only depicted upon the container 54 it can be readily employed upon the more elongated container arrangement depicted in Firs. 1 and 2. The only modification needed would be to shorten the U-shaped bracket to facilitate use on the shorter container shape.

The manner in which the container system 10 of the present invention is employed is described next. With reference to FIGS. 1-2, the container 20 is secured to the upper extent of a conventional fence 22. This is accomplished by screws 44 which are fastened through the back wall of the lower container compartment 28. Preferably the container 20 is secured such that the upper edge of the lower container half 28 is even with the upper edge 24 of the fence 22. Thus, when closed, the upper half 26 of the container is disposed above the line of the fence 22. This arrangement permits the upper surface of the fence 22 to support the lid 26 when in the opened configuration (Note FIG. 2).

Furthermore, by securing the container 20 to the upper extent of the fence 22 access by a user on horse back is permitted. Namely, with the container 20 disposal at a height of between 36 to 60 inches, a user can ride to a position level with the opening of the container 20. The curved surfaces 34 of the container 20 limit the danger of either the rider or horse being injured in the event of contact with the container 20. In other words, the lack of sharp edges will not scrape or cut an animal or its rider. Once positioned, the rider can manipulate the latch to open the lid 26 and thereby gain access to the contents of the container. This permits the rider to take out the needed riding crop 52 or other equestrian implement. Next, the rider can close the lid and proceed with the aid of the crop.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A container system adapted for use by riders on horseback comprising:

a fence terminating at an upper edge, the fence having a height of between 36 and 60 inches and functioning to limit the movement of horses or other livestock;

a weather resistant plastic container comprising interconnected upper and lower halves, the upper half having an opened and closed configuration, each half including a peripheral edge, rounded forward and rearward surfaces interconnected by straight intermediate surfaces, the rounded forward and rearward surfaces preventing injury to riders or their horses upon impact, each half of the container having a length of approximately 50 inches and a depth of approximately 4½ inches, the container thus being dimensioned to house common equestrian implements, a plurality of mounting apertures formed through the rearward surface of the lower half and a plurality of mounting screws positioned through the mounting apertures and secured within the fence immediately adjacent the upper edge, the lower half of the container thus being secured such that when the upper half is in the opened configuration the upper half rests upon the upper edge of the fence, a plurality of drainage apertures formed within the intermediate surface of the lower half, the drainage apertures functioning to drain any liquid out of the container, a plurality of hinges pivotally interconnecting the rearward surfaces of the upper and lower halves, a male latch component formed upon the forward surface of the lower half, a female latch component formed upon the forward surface of the upper half;

an elastomer seal formed about the peripheral edge of the upper and lower halves, such that a watertight seal is formed when the upper half is in a closed configuration;

a riding crop having a length of between 38 and 48 inches, the riding crop positioned within the container, with the height of the container upon the fence permitting riders on horseback to easily access the container and the riding crop without dismounting the horse.

2. A container system adapted for use by riders on horseback comprising:

an elongated, shallow container comprising interconnected upper and lower halves, each half including a periphery and an opening, a plurality of hinges pivotally interconnecting the rearward surfaces of the upper and lower halves, the container being mounted at an elevated position so that the container contents can be accessed by the riders on horseback, each half of the container having rounded forward and rearward edges, the container being dimensioned to receive a variety of equestrian implements;

at least one drainage aperture within the lower half of the container;

a riding crop positioned within the container, with the elevated position of the container permitting riders on horseback to easily access the riding crop without dismounting the horse.

3. The container system as described in claim 2 wherein the container is mounted upon a fence at a height of between 36 and 60 inches.

4. The container system as described in claim 2 wherein the container is entirely formed from a weather resistant plastic material.

5. The container system as described in claim 2 further comprising a male latch component formed upon the forward surface of the lower half of the container and a female latch component formed upon the forward surface of the upper half of the container.

6. The container as described in claim 2 wherein the container is approximately 50 inches in length and accommodates riding crops having lengths of between 38 and 48 inches.

* * * * *